US007726697B2

(12) United States Patent
Kobayashi

(10) Patent No.: US 7,726,697 B2
(45) Date of Patent: Jun. 1, 2010

(54) STRUCTURE FOR CONNECTING HEAT EXCHANGERS

(75) Inventor: Toshimichi Kobayashi, Tokyo (JP)

(73) Assignee: T. Rad. Co., Ltd. (JP)

( * ) Notice: Subject to any disclaimer, the term of this patent is extended or adjusted under 35 U.S.C. 154(b) by 264 days.

(21) Appl. No.: 11/579,211

(22) PCT Filed: Nov. 19, 2004

(86) PCT No.: PCT/JP2004/017250

§ 371 (c)(1),
(2), (4) Date: Oct. 30, 2006

(87) PCT Pub. No.: WO2005/106370

PCT Pub. Date: Nov. 10, 2005

(65) Prior Publication Data

US 2008/0000461 A1 Jan. 3, 2008

(30) Foreign Application Priority Data

Apr. 30, 2004 (JP) ..... 2004-135225

(51) Int. Cl.
*F16L 55/00* (2006.01)

(52) U.S. Cl. ..... 285/41; 285/285.1; 285/364; 285/406

(58) Field of Classification Search ..... 285/19, 285/285.1, 364, 406, 41
See application file for complete search history.

(56) References Cited

U.S. PATENT DOCUMENTS 1,967,466 A * 7/1934 Damsel ..... 285/110

* cited by examiner

*Primary Examiner*—Aaron M Dunwoody
*Assistant Examiner*—Fannie Kee
(74) *Attorney, Agent, or Firm*—Christopher & Weisberg, P.A.

(57) ABSTRACT

A connection structure is provided for connecting heat exchangers (11, 12) to each other for exchanging heat between a first fluid flowing in body parts (13, 14) and a second fluid flowing in heat transfer pipes (15, 16) disposed in the body parts (13, 14). The connection structure includes connection holes (17, 18) provided in the body parts (13, 14) of the heat exchangers (11, 12) and a press-formable connection member (19), connected to the outer surfaces of the body parts (13, 14) for fluidly coupling the connecting holes (17, 18) so that the body parts (13, 14) are allowed to communicate with each other.

8 Claims, 2 Drawing Sheets

STRUCTURE FOR CONNECTING HEAT EXCHANGERS

CROSS-REFERENCE TO RELATED APPLICATION

This application is a national phase for the United States of the PCT Application Serial No. PCT/JP2004/017250, filed Nov. 19, 2004, entitled, CONNECTION STRUCTURE OF HEAT EXCHANGER, which is related to and claims priority to Japanese Patent Application No. 2004-135225, filed Apr. 30, 2004, entitled STRUCTURE FOR CONNECTING HEAT EXCHANGERS, the entirety of all of which are incorporated herein by reference.

FIELD OF THE INVENTION

The present invention relates to a structure for connecting heat exchangers to exchange heat between cooling fluids that pass through an inside portion of body parts and fluid to be cooled that passes through heat transfer pipes installed in the body parts, such as an EGR (Exhaust Gas Recirculation) cooler and the like to be installed in a vehicle with a diesel engine.

BACKGROUND OF THE INVENTION

Recently, the case to install the EGR (Exhaust Gas Recirculation) cooler in vehicles is increasing in order to cut down NOx contained in exhaust gas emitted from a diesel engine, since social requests related to improvement of the natural environment is increasing. Furthermore, the necessity to install plural connected EGR coolers in one vehicle is also increasing in connection with request to improve performance of the EGR cooler.

FIG. 4 shows a prior art structure for connecting heat exchangers. At the structure for connecting heat exchangers, two EGR coolers 1, 2 are connected in series by welding each end of a U-bend pipe 5, respectively, to each body part 3, 4, which cooling fluid passes through, because of space problem in the engine room of the vehicle.

After the cooling water, which enters into the first EGR 1 cooler through an inlet pipe 6, enters into the second EGR cooler 2 through the U-bend pipe 5, it comes out of a outlet pipe 7. In the meantime, the cooling water exchanges heat between the exhaust gases passing through heat transfer pipes (not shown) installed in each body part 3, 4 and cools down the exhaust gases.

In addition, at the saltwater heat exchangers used in the nuclear power plant and the like, heat exchangers are connected by the U-bend pipe as the above case (See Japanese Unexamined Utility Model Application No. 56-89590).

However, in the above-mentioned prior structure for connecting heat exchangers, there are problems that it is difficult to form the U-bend pipe and to weld it to the each body part. Also, costs for parts and labor are expensive, because it is necessary to use the U-bend pipes, which bend radius is small, to connect the heat exchangers.

Furthermore, there is a problem that it is difficult to install the U-bend pipe in the small space, such as the engine room of the vehicle, because a little space is provided to install the U-bend pipe.

In addition, there is a problem that it is difficult to improve the efficiency because fluid resistance and power for transferring the fluid become larger.

In order to overcome the above problems, the object of the present invention is to provide a structure for connecting heat exchangers to be able to reduce the cost and space for installation and to improve the efficiency.

SUMMARY OF THE INVENTION

In order to achieve the above objects, the present invention is a structure for connecting heat exchangers to exchange heat between a cooling fluid that passes through the inside of body parts and fluid to be cooled that passes through the inside of heat transfer pipes installed in the body parts. The structure includes a connecting hole opened respectively at each body part of the heat exchangers to be connected and a press-formable connecting member that is connected on the external face of the each body part around the connecting hole so that each body part is fluidly coupled.

According to the present invention, it is possible to make the labor easy, to reduce the cost, and to reduce the space for installation, because the connecting member can be formed using a press-formable connecting member.

Furthermore, it is possible to design the shape of the connecting member and the connecting hole freely to some extent because the connecting member is connected to the external face of the each body part around the connecting hole without being connected to the connecting hole directly. Accordingly, it is possible to carry out optimum design by taking into account the flow and resistance of the cooling water and to improve the heat exchange efficiency and reduce the power for transferring the fluid.

DESCRIPTION OF THE PREFERRED EMBODIMENT

Figure 1:
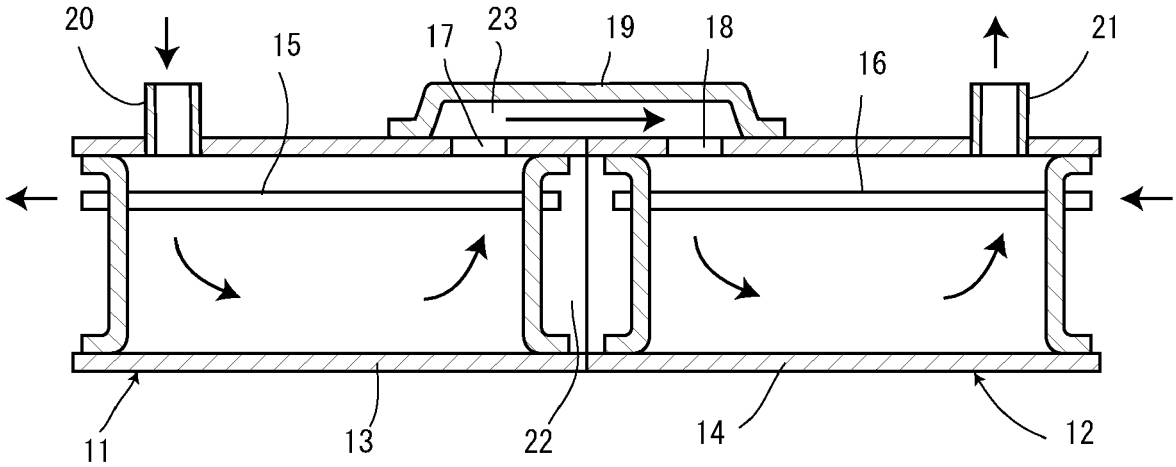
FIG. 1 is a section view showing a structure for connecting heat exchangers according to an embodiment of the present invention.
Figure 2:
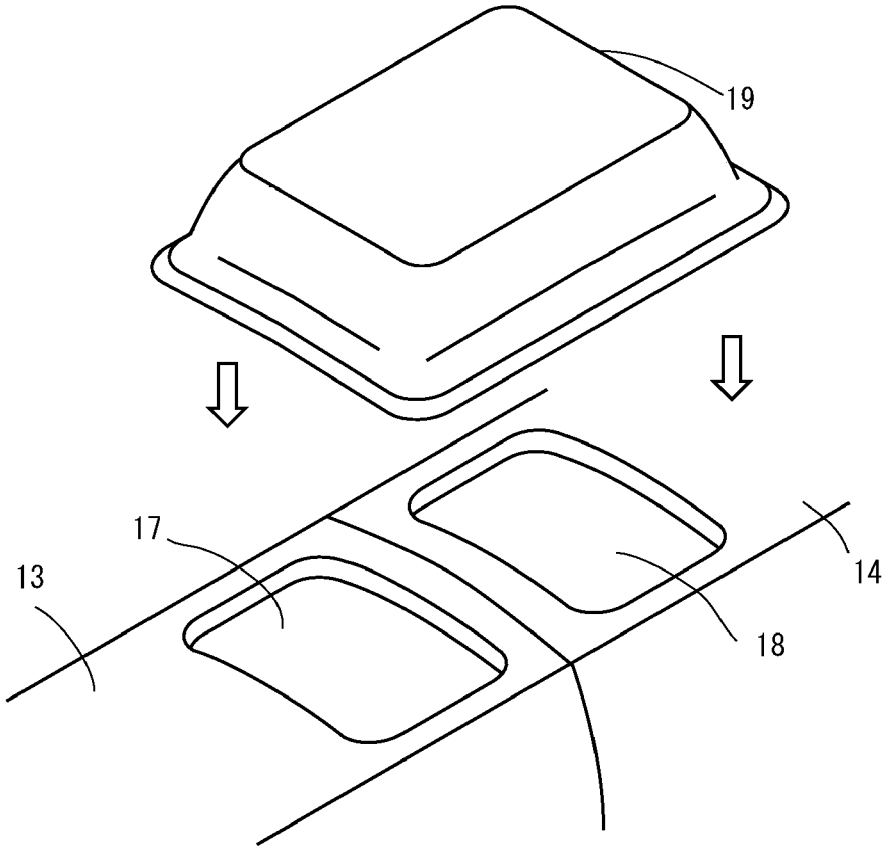
FIG. 2 is a perspective view showing the structure for connecting heat exchangers according to the embodiment of the present invention.

We will now describe an embodiment of the present invention with reference to the accompanying drawings. FIG. 1 is a section view showing a structure for connecting heat exchangers according to an embodiment of the present invention, and FIG. 2 is a perspective view showing the structure for connecting heat exchangers according to the embodiment of the present invention. We will describe the case to apply the present invention to the EGR cooler as an example thereinafter.

According to the embodiment of the present invention, the first EGR cooler and the second EGR cooler are configured to be connected to each other in series. Each EGR cooler 11, 12 essentially consists of a body part 13, 14 and heat transfer pipes 15, 16 installed in each body part 13, 14, respectively, so that heat can exchange between cooling water passing through inside of body parts 13, 14 and exhaust gases passing through inside of heat transfer pipes 15, 16. A connecting hole 17, 18 is opened respectively at each end adjacent to the connecting part of the first EGR cooler 11 and the second EGR cooler 12 so that a connecting member 19 can be connected the external face of the each body part 13, 14 around each connecting hole 17, 18 by brazing or welding.

The connecting member 19 is formed in a flat plate shape by pressing a plate member. A path 23 is formed between the connecting member 19 and each body part 13, 14 by connecting the connecting member 19 to the external face of the each body part 13, 14 so that each body part 13, 14 is fluidly connected via the path 23 and each connecting hole 17, 18. A cooling water inlet pipe 20 is connected to an opposite end of the body part 13 with respect to the connecting hole 17 of the first EGR cooler 11 and also a cooling water outlet pipe 21 is connected to an opposite end of the body part 14 with respect to the connecting hole 18 of the second EGR cooler 12. Furthermore, a header part 22 of the heat transfer pipe is formed at the connecting part between the first EGR cooler 11 and the second EGR cooler 12 so that the both heat transfer pipes 15, 16 can go thorough via the header part 22 of the heat transfer pipe.

It is possible to make the labor simple and to reduce the cost since the connecting member 19 can be formed by a pressing operation. Furthermore, it is possible to design the shape of the connecting hole 17, 18 freely to some extent such as a square, an oval and the like, regardless of the shape of the connecting member 19. As a result, an optimum design may be employed taking into account the flow and resistance of the cooling water, because the connecting member 19 is not connected to the connecting hole 17, 18 directly. In addition, it is possible to install more than two connecting members 19 since the connecting member 19 is formed in a flat plate shape and a large space for the installation is not required. Accordingly, in that case, it is possible to improve the flow of the cooling water, improve the heat exchange efficiency and reduce the power for transferring the fluid.

According to the above structure, the cooling water enters into the body part 13 of the first EGR cooler 11 via the cooling water inlet pipe 20, and passes through the connecting hole 17, the path 23, the connecting hole 18. Then the cooling water comes out of the cooling water outlet pipe 21 after passing through the body part 14 of the second EGR cooler 12. On the other hand, a portion of the exhaust gases of the diesel engine pass through the heat transfer pipe 16 of the second EGR cooler 12 in the opposite direction to the flow of the cooling water. Then, the exhaust gases return to the an intake part of the diesel engine after passing through the first EGR cooler 11 via the header part 22 of the heat transfer pipe. In the meantime, the cooling water exchanges heat between the exhaust gases and it is cooled down at the preferred condition.

Figure 3:
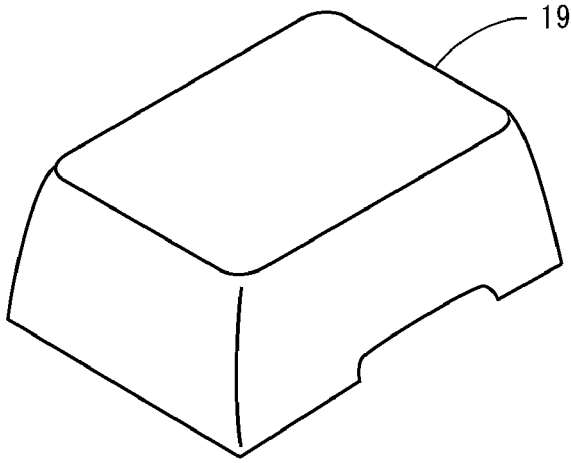
FIG. 3 is a perspective view showing another example of the connecting member at the structure for connecting heat exchanges according to the embodiment of the present invention.
Figure 4:
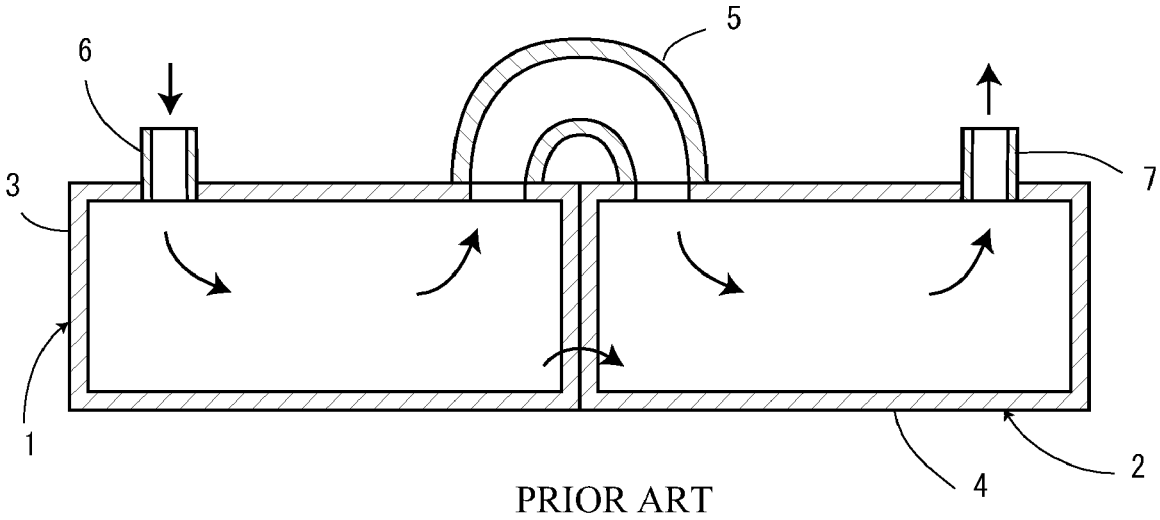
PRIOR ART Fig. 4
FIG. 4 is a section view showing the prior art.

In addition, the connecting member 19 is not limited to the above shape and may be in the other shape which can be press formed, such as vaulting horse shape and the like as shown on the FIG. 3.

Furthermore, although the first EGR cooler 11 and the second EGR cooler 12 are connected in series, the present invention is applicable to the case that the each EGR cooler 11, 12 are connected in parallel, or the case that more than three EGR coolers are connected.

Although the embodiment of the present invention has been described in the EGR cooler, it is to be understood by those skilled in the art that the present invention is applicable to the heat exchangers other than the EGR cooler.

What is claimed is:

1. A structure for exchanging heat between a first fluid flowing in heat exchangers and a second fluid flowing in heat transfer pipes disposed within the heat exchangers comprising:

a first heat exchanger;

a first aperture provided in the first heat exchanger;

a second heat exchanger;

a second aperture provided in the second heat exchanger; and a cover having a single opening, the cover comprising:

a base;

a flange encircling the single opening, the flange being sized to circumvent the first aperture and the second aperture; and side walls that couple the base and the flange, the cover having a hollow interior that fluidly couples the first aperture and the second aperture.

2. The structure according to claim 1, further comprising a heat transfer pipe that is disposed within at least one of the first heat exchanger housing and the second heat exchanger, the heat transfer pipe being exposed to a fluid flowing through the at least one of the first heat exchanger and the second heat exchanger.

3. The structure according to claim 2, wherein a first fluid flows in a first direction in the at least one of the first heat exchanger and the second heat exchanger and a second fluid flows in a second direction in the heat transfer pipe, wherein the first direction and the second direction are opposite.

4. The structure according to claim 1, wherein a cross-sectional shape of at least one of the first aperture and the second aperture are different than a cross-sectional shape of the single opening.

5. The structure according to claim 1, wherein the first heat exchanger and the second heat exchanger include a plurality of side members and the cover is affixed to a selected side member of the first heat exchanger and the second heat exchanger.

6. The structure according to claim 5, wherein the cover is coupled to the selected side member by at least one of brazing and welding.

7. The structure according to claim 1, wherein a cross-sectional shape of the first aperture defines a first area, a cross-sectional shape of the second aperture defines a second area, and a cross-sectional shape of the single opening defines a third area.

8. The structure according to claim 7, wherein the third area is larger than a sum of the first area and the second area.

* * * * *